US011048210B2

(12) United States Patent
Zaugg et al.

(10) Patent No.: US 11,048,210 B2
(45) Date of Patent: Jun. 29, 2021

(54) WATCH MOVEMENT INCLUDING A MULTIAXIAL TOURBILLON

(71) Applicant: Montres Breguet S.A., L'Abbaye (CH)

(72) Inventors: Alain Zaugg, Le Sentier (CH); Christophe Riedo, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 134 days.

(21) Appl. No.: 16/053,991

(22) Filed: Aug. 3, 2018

(65) Prior Publication Data

US 2019/0056695 A1 Feb. 21, 2019

(30) Foreign Application Priority Data

Aug. 21, 2017 (EP) ..... 17187096

(51) Int. Cl.
*G04B 17/28* (2006.01)
*G04B 31/008* (2006.01)

(52) U.S. Cl.
CPC ..... *G04B 17/285* (2013.01); *G04B 31/008* (2013.01)

(58) Field of Classification Search
CPC .... G04B 17/28; G04B 17/285; G04B 31/008; G04B 31/00
See application file for complete search history.

(56) References Cited

U.S. PATENT DOCUMENTS 7,160,026 B2 * 1/2007 Golay ..... G04B 17/285 368/127
8,956,041 B2 * 2/2015 Forsey ..... G04B 17/285 368/127
9,568,887 B2 * 2/2017 Kawauchiya ..... G04B 15/10
9,645,550 B2 * 5/2017 Corthesy ..... G04B 17/285
D843,230 S * 3/2019 Miodrag ..... D10/39
2005/0201209 A1 * 9/2005 Golay ..... G04B 17/285 368/127
2006/0187760 A1 * 8/2006 Kasapi ..... G04B 17/285 368/127
2014/0126338 A1 * 5/2014 Forsey ..... G04B 17/285 368/127
2016/0266547 A1 * 9/2016 Kawauchiya ..... G04B 15/10

FOREIGN PATENT DOCUMENTS

CH 242661 5/1946
DE 11 2012 000 574 T5 11/2013

OTHER PUBLICATIONS

European Search Report dated Jan. 19, 2018 in European Application 17187096.7 filed on Aug. 21, 2017 (with English Translation of Categories of Cited Documents & Written Opinion).

* cited by examiner

*Primary Examiner* — Sean Kayes
(74) *Attorney, Agent, or Firm* — Oblon, McClelland, Maier & Neustadt, L.L.P.

(57) ABSTRACT

A watch movement includes a frame having a first bearing and a second bearing, and a tourbillon including two cages, of which one cage is known as the external cage. The external cage is mounted in a pivoting manner on the frame between the first bearing and the second bearing. The movement also includes two watch jewels supporting two pivots of the external cage. Additionally, the movement includes two translational elements capable of displacement in relation to the bearings in the axis of rotation of the external cage in the assembled position of the external cage on the frame, so as to cause a displacement of the watch jewels or a displacement of the pivots.

8 Claims, 4 Drawing Sheets

WATCH MOVEMENT INCLUDING A MULTIAXIAL TOURBILLON

Figure 1:
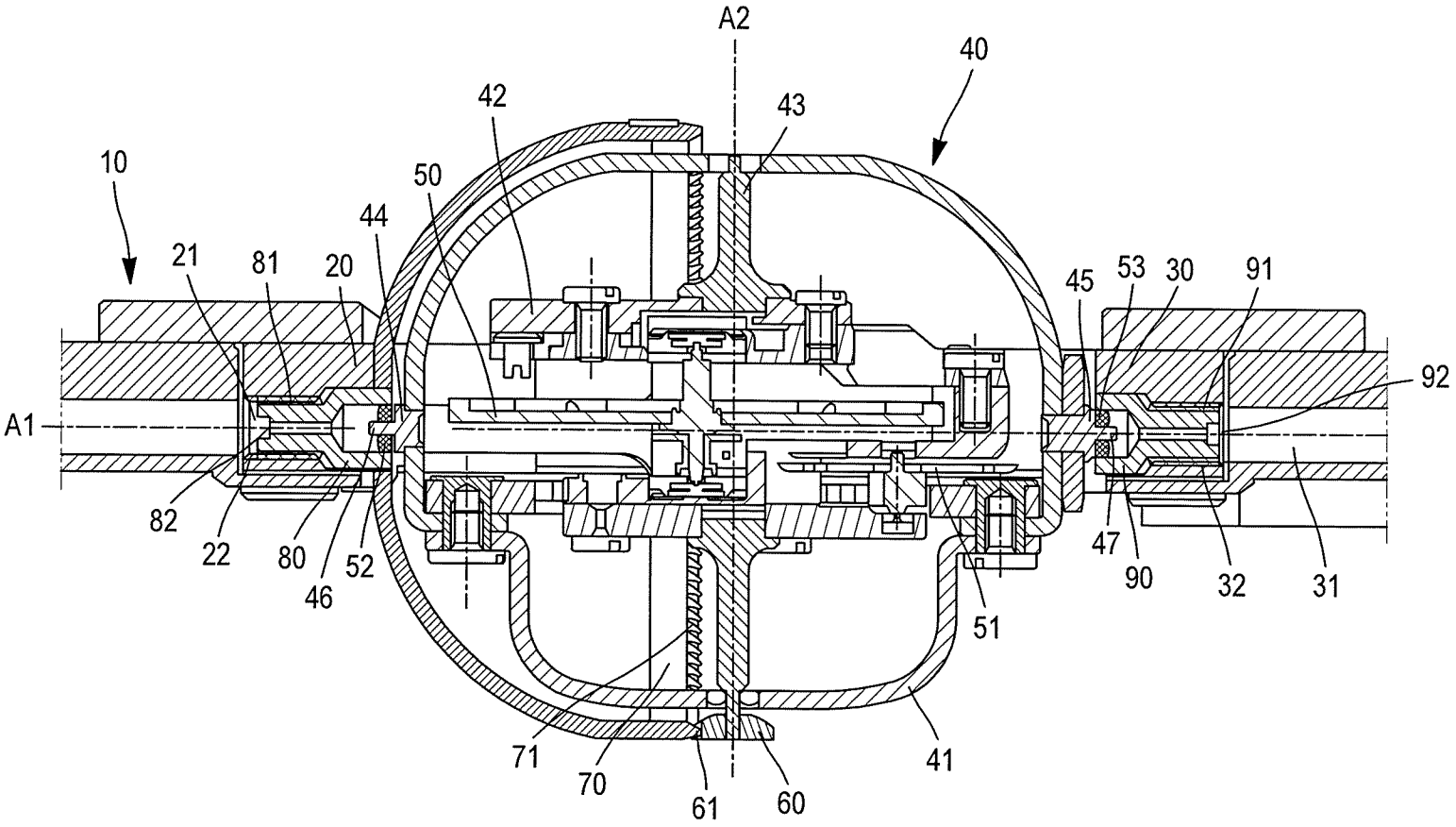

This application claims priority from European Patent Application No. 17187096.7 filed on Aug. 21, 2017, the entire disclosure of which is hereby incorporated herein by reference.

FIELD OF THE INVENTION

The invention relates to a multiaxial tourbillon, that is to say at least biaxial, including a first cage, commonly referred to as an external cage, mounted in a pivoting manner on two fixed bearings.

BACKGROUND TO THE INVENTION

Tourbillons, also known as "rotating cages", added to escapement mechanisms to improve the precision of mechanical watches by counteracting the disturbances of the isochronism of the balance wheel due to terrestrial gravity, are known in watchmaking.

Good's bi-axial tourbillon, described in detail in "Alte Uhren" 4/79 and commonly referred to as the double tourbillon, has been known since 1978. This type of tourbillon includes two nested cages. A first cage, referred to as the external cage, is rotatably mounted in relation to a frame of the movement, supported on both sides by a first and a second bearing of the frame. A second cage is housed in the interior of the first cage and is rotatably mounted in relation to the external cage. The second cage pivots by means of a staff which extends across the external cage and which is supported by the external cage. The staff is constrained to rotate with a pinion, said pinion being fixed on one extremity of the staff that is present on the exterior of the external cage. The pinion is in engagement with a wheel, fixed in relation to the frame, of which the axis coincides with the axis of rotation of the external cage. Rotation of the second cage thus results in rotation of the pinion and, in so doing, its displacement along the toothing of the fixed wheel. This displacement induces rotation of the staff in the axis of rotation of the external cage and consequently rotation of the external cage.

The rotations of the external cage are permitted by the cooperation between pivots of the external cage and watch jewels pressed into the bearings. The watch jewels take the form of drilled discs, making it possible to receive and maintain the pivots axially. It will be appreciated that moving the watch jewels apart or together in relation to each other permits the movement of the external cage to be regulated, and that displacing the two watch jewels jointly on the axis of rotation of the external cage makes it possible to regulate the gearing clearance, that is to say the centre distance between the pinion and the fixed wheel, in a very precise manner.

At the present time, when it is wished to regulate the movement of the external cage and/or the gearing clearance between the pinion and the fixed wheel, the external cage must first be disassembled from the bearings on which it rests. More specifically, the pivots of the external cage must be removed from the watch jewels. The watch jewels are then accessible and may thus be displaced in relation to the bearings in the axis of rotation of the external cage, conventionally by means of a jewelling press. Once the jewels are positioned correctly, the pivots of the external cage are replaced in the watch jewels. Naturally, it will be appreciated that this procedure is laborious.

SUMMARY OF THE INVENTION

The aim of the present invention is to address the previously mentioned shortcoming by proposing a watch movement in which the movement of the external cage and/or the gearing clearance between the pinion and the fixed wheel is adjustable in a simple manner without being obliged to disassemble the tourbillon.

To this end, the invention proposes a watch movement.

It is possible to displace the watch jewels or the pivots by means of the translational elements and, in so doing, to regulate the gap between the two jewels and/or the position of the cage on its axis of rotation, and consequently the movement of the external cage and/or the gearing clearance between the pinion and the fixed wheel.

Two embodiments are thus conceivable.

It will be appreciated that the movement of the external cage and the gearing clearance between the pinion and the fixed wheel may be regulated as follows: the movement of the external cage is regulated by displacing the watch jewels one in relation to the other, whereas the gearing clearance is regulated by displacing the watch jewels simultaneously so as to displace them in the same direction while preserving the same gap between them.

Other advantageous variants of the invention, which may be considered alone or according to all the technically possible combinations, are defined.

SUMMARY DESCRIPTION OF THE DRAWINGS

Figure 2:
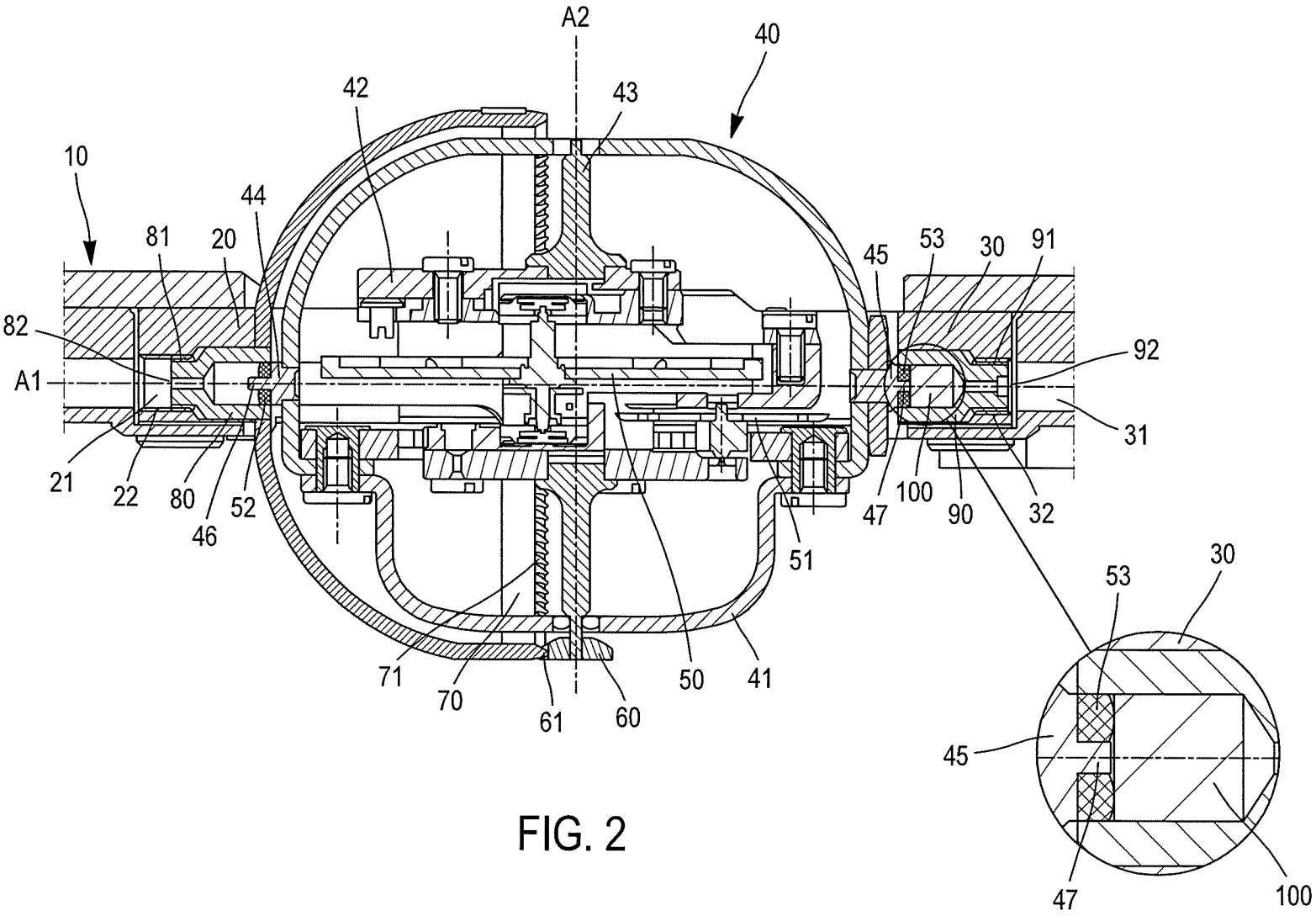
Figure 3:
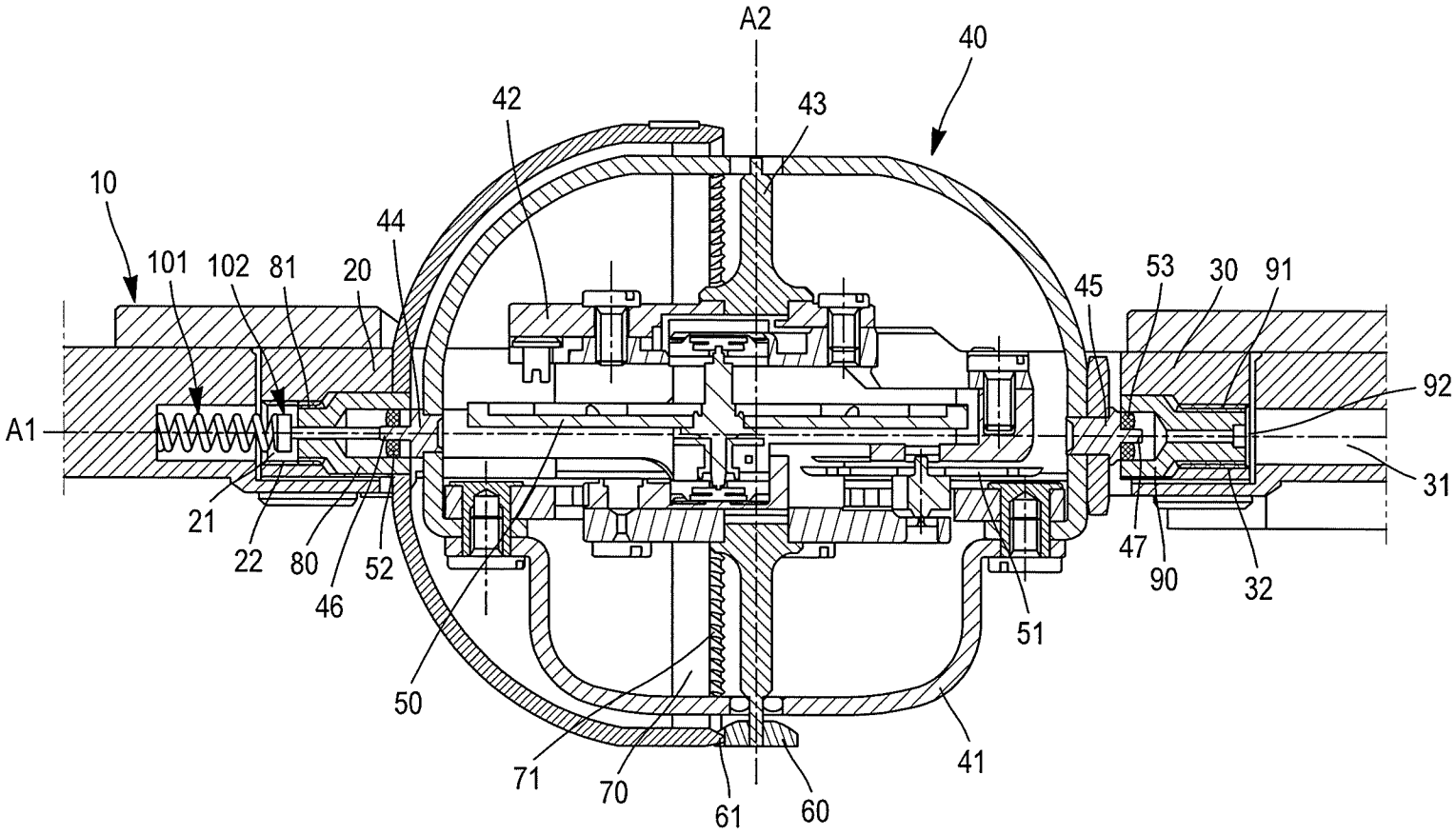
Figure 4:
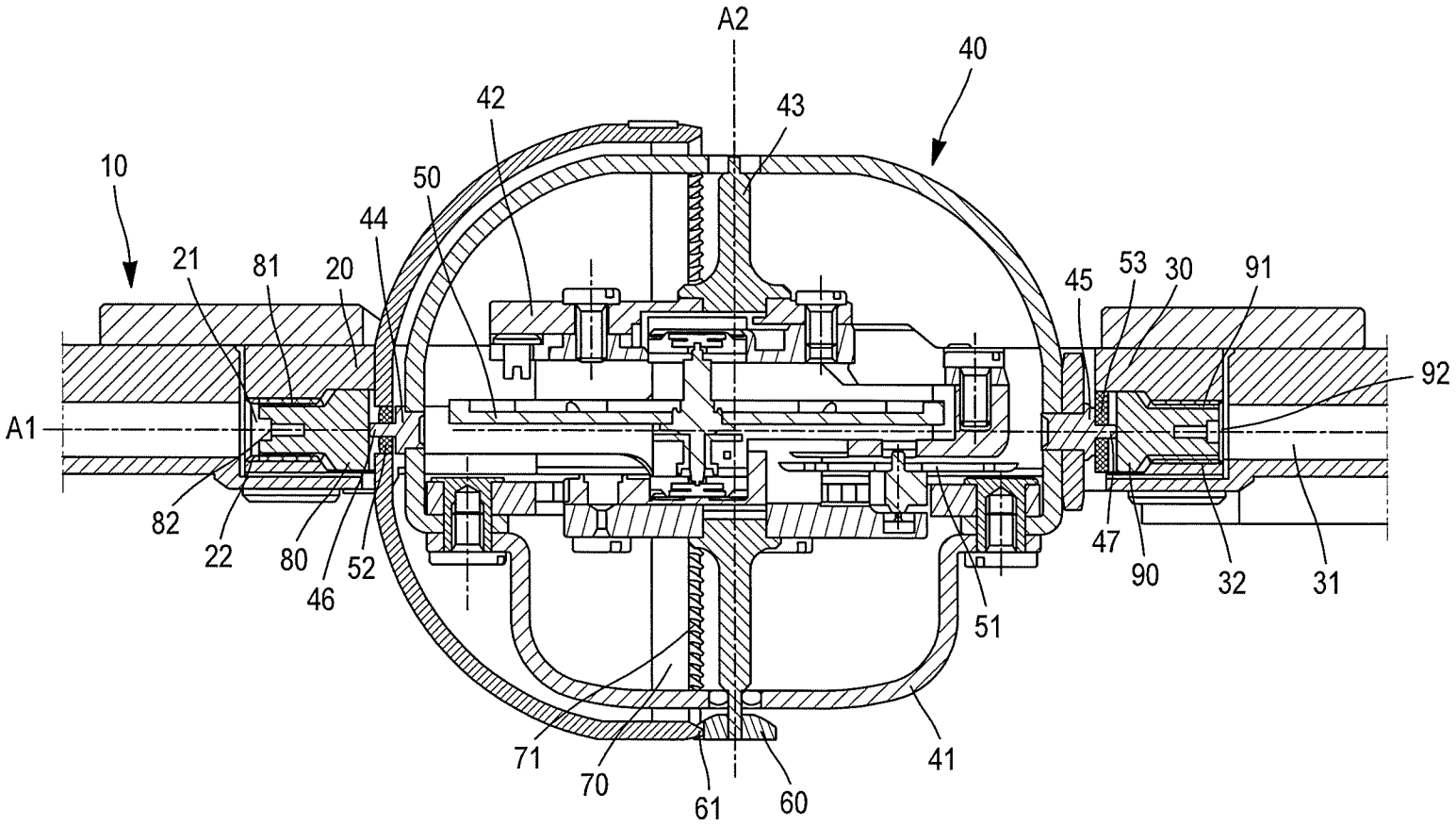

Other features and advantages will be appreciated clearly from the description that is given below, for information purposes and in no way restrictive, with reference to the accompanying drawings, in which:

FIG. 1 depicts a biaxial tourbillon mounted in a pivotable manner between two bearings according to a first embodiment of the invention FIG. 2 depicts the tourbillon in FIG. 1, mounted in a pivotable manner between the two bearings according to a second embodiment of the invention FIG. 3 depicts the tourbillon in FIG. 1, mounted in a pivotable manner between the two bearings according to a third embodiment of the invention FIG. 4 depicts the tourbillon in FIG. 1, mounted in a pivotable manner between the two bearings according to a fourth embodiment of the invention.

DETAILED DESCRIPTION OF PREFERRED EMBODIMENTS

FIGS. 1 to 4 show a tourbillon 40 supported on both sides by bearings 20, 30 of a frame 10 of a watch movement according to the invention.

The tourbillon 40 illustrated here includes two concentric cages, a first cage known as the external cage 41 and a second cage known as the internal cage 42. The internal cage 42 contains among other things a balance wheel 50, a spring, a pallet and an escape wheel 51. The internal cage 42 is mounted in a pivoting manner on the external cage 41 along an axis of rotation A2. The tourbillon 40 thus includes a staff 43 that is constrained to rotate with the internal cage 42 and extends across the external cage 41 along the second axis of rotation A2. The staff 43 includes two extremities, said two extremities being supported by two watch jewels positioned on two opposing walls of the external cage 41. One of the extremities passes through the watch jewel which supports it and thus includes an end zone which extends to the exterior of the external cage 41.

A pinion 60, commonly referred to as the second pinion, is mounted on this end zone so as to be constrained to rotate with the staff 43. The second pinion 60 includes a toothing 61 in engagement with a toothing 71 of a wheel 70, fixed in relation to the frame 10, commonly referred to as the third fixed wheel. The third fixed wheel 70 is mounted concentrically with the first bearing 20, and its axis extends in the axis of rotation A1 of the external cage 41, said axis of rotation A1 being perpendicular to the axis of rotation A2 of the internal cage 42, or inclined at an angle of between 30 and 150 degrees in relation to the axis of rotation A2 of the internal cage 42.

Rotation of the internal cage 42, equivalent to rotation of the staff 43, thus results in rotation of the second pinion 60, which results in rotation of the external cage 41 by means of the displacement of the second pinion 60 in the toothing 71 of the third wheel 70.

The external cage 41 includes a first pivot 44 supported by a first watch jewel 52 and a second pivot 45 supported by a second watch jewel 53. These pivots 44, 45 are positioned on the axis of rotation A1 of the external cage 41 and are secured to opposing walls of the external cage 41. The first pivot 44, and respectively the second pivot 45, includes an extremity 46, and respectively an extremity 47, passing through the first watch jewel 52, and respectively the second watch jewel 53, in the axis of rotation A1 of the external cage 41. The watch jewels are in fact drilled at their centre, in a conventional manner, so as to receive the extremity of a pivot.

In the embodiment in FIG. 1, the first watch jewel 52 is itself supported by a first translational element 80 housed in a first orifice 21 of the first bearing 20. The first watch jewel 52 is integral with the first translational element 80. As for the second watch jewel 53, this is supported by a second translational element 90 housed in a second orifice 31 of the second bearing 30. The second watch jewel 53 is integral with the second translational element 90.

The orifices 21, 31, and a fortiori the translational elements 80, 90 housed in said orifices 21, 31, extend in the axis of rotation A1 of the external cage 41, on both sides of the external cage 41. Each translational element 80, 90 thus includes a first extremity on the side of the external cage 41, facing one of the pivots 44, 45. The first watch jewel 52 is maintained at the level of the extremity of the first translational element 80 on the side of the external cage 41, whereas the second watch jewel 53 is maintained at the level of the extremity of the second translational element 90 on the side of the external cage 41. The translational elements 80, 90 are hollow, for example, and the watch jewels 52, 53 are housed in these cavities. Naturally, the axis of the watch jewels 52, 53 coincides with the axis of rotation A1 of the external cage 41, the axis of the translational elements 80, 90 and the axis of the pivots 44, 45. It will be appreciated that displacing the translational elements 80, 90 makes it possible to displace the watch jewels 52, 53, the watch jewels being integral with the translational elements.

Depicted in FIG. 4 is an alternative embodiment in which the watch jewels 52, 53 are not integral with the translational elements 80, 90, but are integral with the frame 10. More specifically, the first watch jewel 52 is integral with the first bearing 20, and the second watch jewel 53 is integral with the second bearing 30. Furthermore, the first translational element 80 rests against the extremity 46 of the first pivot 44, and the second translational element 90 rests against the extremity 47 of the second pivot 45. It will therefore be appreciated that displacing the translational elements 80, 90 makes it possible to displace the pivots 44, 45 relative to the watch jewels 52, 53.

In the embodiment in FIG. 1, as in that of FIG. 4, each translational element 80, 90 includes actuating means 82, 92 at its extremity opposite that on the side of the external cage 41. The translational elements 80, 90 may be displaced by cooperation between a tool and the actuating means 82, 92. The actuating means 82, 92 are accessible from the exterior via the orifices 21, 31. The two translational elements 80, 90 may thus be displaced in the axis of rotation A1 of the external cage 41 by means of the actuating means 82, 92.

Advantageously, the first translational element 80 and the second translational element 90 are two sleeves that are threaded at least in part. In the depicted example, each of these sleeves includes a threaded cylindrical portion 81, 91 and a non-threaded cylindrical portion. The threaded portion 81, 91 has a diameter smaller than the diameter of the non-threaded portion. Naturally, since it receives one of the translational elements, each orifice 21, 31 includes a tapped cylindrical portion 22, 32 of the same diameter as the threaded portions 81, 91, and a non-threaded cylindrical portion of the same diameter as the non-threaded portions. When the translational elements 80, 90 are elements that are threaded at least in part, more particularly sleeves, the actuating means 82, 92 are typically a slot into which a screwdriver may be inserted in order to impart a helicoidal movement to the translational elements 80, 90.

Furthermore, it is advantageous to provide the movement with a repositioning element. The presence of a repositioning element is optional. The repositioning element makes it possible to ensure that the external cage remains in or returns immediately to its initial position when it is subjected to a shock.

In an embodiment depicted in FIG. 2 and constituting an improvement of the embodiment in FIG. 1, the repositioning element is a magnet 100 housed in a cavity of the second translational element 90 and is therefore integral with the second translational element 91. The magnet 100 is maintained against the second watch jewel 53 and, more specifically, on the side of the second watch jewel 53 which is opposite the side where the external cage 41 is present. As mentioned previously, the second watch jewel 53 is drilled at its centre so as to receive the extremity 47 of the second pivot 45, the drilling extending in the axis of rotation A1 of the external cage 41, between the face of the second watch jewel 53 that is present on the side of the external cage 41, and the opposing face. The magnet 100 is thus in contact with, or at least in close proximity to, said extremity 47 of the second pivot 45. By selecting a material adapted for the second pivot 45, for example iron, a force of attraction is present between the magnet 100 and the second pivot 45.

In FIG. 2, the magnet is depicted in combination with the embodiment in FIG. 1, although it will be appreciated that it could have been combined with the embodiment in FIG. 4. In the embodiment in FIG. 4, it would be sufficient to create a cavity in the second translational element 90, said cavity discharging at the level of the extremity 47 of the second pivot 45, and to position the magnet 100 in this cavity so that the magnet is in contact with the extremity 47.

If the movement is subjected to a shock causing the external cage 41 to move away from the second bearing 30, the magnet 100 ensures that the second pivot 45, and a fortiori the external cage 41, resumes its initial position. In more general terms, the addition of a magnetic element in proximity to or in contact with one of the pivots 44, 45 of the external cage 41 makes it possible to maintain said pivot in, or to return it into, forced contact against the watch jewel 52, 53 which supports said pivot 44, 45. This forced contact ensures an invariable position of the external cage 41 and, in the same way, a uniform gearing centre distance between the pinion 60 and the fixed wheel 70. Conventionally, the gearing centre distance between the pinion and the fixed wheel must be accurate to within 0.02 millimetres, and the movement of an external tourbillon cage is in the order of 0.05 millimetres at a maximum; it will be appreciated, therefore, that it is advantageous to force the contact of one of the pivots against its watch jewel.

In the embodiment depicted in FIG. 3, the repositioning element is an assembly consisting of a spring 101 and a piston 102, on this occasion installed on the side of the first translational element 80. It will be noted that the actuating means 82 of the first translational element 80 are not then accessible, since the spring 101 and the piston 102 block the access to said actuating means 82, and since the first orifice 21 is not transcurrent. Thus, only the second translational element 90 may be displaced via the access to the actuating elements 92 through the second orifice 31.

The axis of the piston 102 passes through the first translational element 80 in the axis of rotation A1 of the external cage 41 and rests against the extremity 46 of the first pivot 44. The head of the piston 102, on the exterior of the first translational element 80, rests against the spring 101, which also extends in the axis of rotation A1 of the external cage 41. The spring 101 is housed in the first orifice 21 of the first bearing 20, said first orifice 21 also containing the first translational element 80. As mentioned previously, the first orifice 21 is not transcurrent: at its extremity opposite the piston 102, the spring 101 may thus push against a wall of the first orifice 21. When the movement is subjected to a shock causing the external cage 41 to move away from the second bearing 20, the first pivot 44 exerts a pressure against the piston 102, feeding back at the level of the head of the piston onto the spring 101 and compressing said spring 101. By seeking to return to its initial position, the spring 101 displaces the piston 102 in the direction of the external cage 41, the axis of the piston 102 then exerting a pressure against the first pivot 44, with the result that the external cage 41 resumes its initial position.

In FIG. 3, it is depicted that the first translational element 80 is of the same type as that illustrated in FIG. 1, although there is naturally nothing to prevent it from being of the same type as that illustrated in FIG. 4. It would be sufficient to provide the first translational element 80 with a cavity passing through it from one side to the other, in order to insert the axis of the piston 102 at that point. Furthermore, there is also nothing to prevent the second translational element 90 from being of the same type as that illustrated in FIG. 4.

Of course, the present invention is not restricted to the illustrated example, but lends itself to different variants and modifications which will be evident to a person skilled in the art. In particular, the tourbillon could comprise more than two cages, the invention concerning above all the attachment of the external cage.

| List of Reference Designations | |
|---|---|
| 10 | frame |
| 20 | first bearing |
| 21 | first orifice |
| 22 | tapping |

-continued

| List of Reference Designations | |
|---|---|
| 30 | second bearing |
| 31 | second orifice |
| 32 | tapping |
| 40 | tourbillon |
| 41 | external cage |
| 42 | internal cage |
| 43 | staff |
| 44 | first pivot |
| 45 | second pivot |
| 50 | balance wheel |
| 51 | escape wheel |
| 52 | first watch jewel |
| 53 | second watch jewel |
| 60 | pinion |
| 61 | toothing |
| 70 | fixed wheel |
| 71 | toothing |
| 80 | first translational element |
| 81 | thread |
| 82 | actuating means |
| 90 | second translational element |
| 91 | thread |
| 92 | actuating means |
| 100 | magnet |
| 101 | spring |
| 102 | piston |

What is claimed is:

1. A watch movement comprising:

a frame comprising a first bearing and a second bearing;

a tourbillon comprising two cages, of which one cage is known as the external cage, the external cage being mounted on the frame by the first bearing and the second bearing, the external cage being pivotable with respect to the frame around an axis of rotation of the external cage;

two watch jewels supporting two pivots of the external cage;

two translational elements, including a first translational element and a second translational element, capable of displacement in relation to the bearings along the axis of rotation of the external cage in the assembled position of the external cage on the frame, so as to cause a displacement of the watch jewels or a displacement of the pivots; and a repositioning element housed at least in part in a cavity of the first translational element to maintain one of the pivots in a reference position in relation to the watch jewel which supports it, wherein the repositioning element is a magnet housed in part or integrally in the cavity.

2. The watch movement according to claim 1, wherein each of the translational elements is integral with one of the watch jewels.

3. The watch movement according to claim 1, wherein each watch jewel is integral with a bearing, and at least one of the translational elements is in contact with one extremity of one of the pivots or with a repositioning element, which is itself in contact with one extremity of one of the pivots.

4. The watch movement according to claim 1, wherein of the translational elements includes actuating means that are accessible via an orifice of the bearing which supports said translational element.

5. The watch movement according to claim 4, wherein the actuating means comprise a slot for the insertion therein of a tool such as a screwdriver.

6. The watch movement according to claim 4, wherein each of the translational elements is a sleeve comprising a thread in engagement with a tapping of the orifice.

7. The watch movement according to claim 1, wherein each translational element is supported by a bearing, by a bridge or by a plate of the watch movement.

8. A watch movement, comprising:

a frame comprising a first bearing and a second bearing;

a tourbillon comprising two cages, of which one cage is known as the external cage, the external cage being mounted on the frame by the first bearing and the second bearing, the external cage being pivotable with respect to the frame around an axis of rotation of the external cage;

two watch jewels supporting two pivots of the external cage;

two elements, including a first element and a second element, and only the second element is capable of displacement in relation to the bearings along the axis of rotation of the external cage in the assembled position of the external cage on the frame, so as to cause a displacement of one of the watch jewels or a displacement of one of the pivots without removing the external cage from the bearings;

a repositioning element housed at least in part in a cavity of the first element to maintain one of the pivots in a reference position in relation to the watch jewel which supports it, wherein the repositioning element comprises a spring and a piston, both housed in a first orifice of the first bearing, the axis of the piston extending through the first element in the axis of rotation of the external cage, the piston resting on the one hand on one extremity of the first pivot and on the other hand on the spring, the second element being capable of displacement in the axis of rotation of the external cage.

* * * * *